United States Patent [19]

Gough et al.

[11] Patent Number: 4,476,413

[45] Date of Patent: Oct. 9, 1984

[54] ATOMIC SPECTRAL LAMP

[75] Inventors: David S. Gough, Blackburn South; John V. Sullivan, Carnegie, both of Australia

[73] Assignee: Commonwealth Scientific and Industrial Research Organization, Australia

[21] Appl. No.: 243,404

[22] Filed: Mar. 13, 1981

Related U.S. Application Data

[63] Continuation of Ser. No. 41,463, May 22, 1979.

[30] Foreign Application Priority Data

May 22, 1978 [AU] Australia ..... PD4468
Aug. 17, 1978 [AU] Australia ..... PD5545

[51] Int. Cl.[3] ..... H01J 19/68
[52] U.S. Cl. ..... 313/550; 313/612
[58] Field of Search ..... 313/209, 180, 204, 220, 313/216, 223, 636, 612, 624, 611, 549, 550

[56] References Cited

U.S. PATENT DOCUMENTS 1,935,697 11/1933 Davies et al. ..... 313/220 X
1,994,306 3/1935 Ewest et al. ..... 313/216 X
2,020,726 11/1935 Gaidies ..... 313/204
2,189,636 2/1940 Knowles et al. ..... 313/216 X
2,766,395 10/1956 Schumichen ..... 313/216 X
2,774,013 12/1956 Willoughby ..... 313/204
2,805,365 9/1957 Mulder ..... 313/180 X

OTHER PUBLICATIONS

Engelhard and Bayer-Helms, "Cd and Hg Cathode Spectral Lamps for Interferometry," Metrologia 8, 91-96, (1972), No. 3, (Jul.).

*Primary Examiner*—David K. Moore
*Attorney, Agent, or Firm*—Sughrue, Mion, Zinn, Macpeak & Seas

[57] ABSTRACT

An atomic spectral lamp of the type comprising a predominantly glass envelope in which are disposed spaced electrodes for producing an electrical discharge on application of a suitable potential difference thereto and a substance which, on being heated will yield a vapor of an element capable of emitting the resonance line or lines which characterize the lamp. In normal operation of the lamp, there exists between the anode and the cathode a temperature gradient effective to ensure that the vapor pressure of the elemental vapor adjacent the cathode is small relative to the vapor pressure of the elemental vapor in the vicinity of said substance. In another aspect, heating means is provided for heating the substance independently of the discharge to yield the elemental vapor within the envelope.

12 Claims, 2 Drawing Figures

ATOMIC SPECTRAL LAMP

Figure 1:
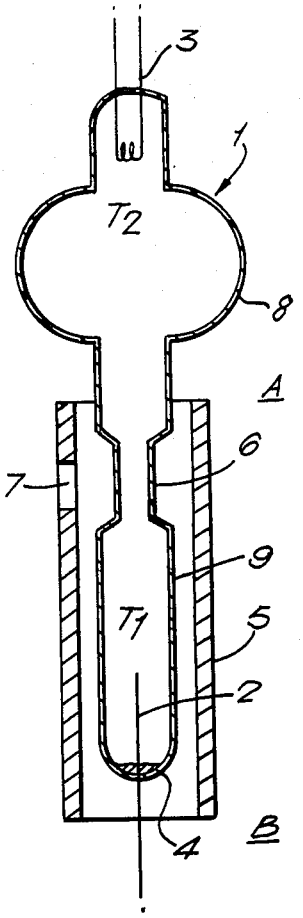

This is a continuation, of application Ser. No. 41,463, filed May 22, 1979.

This invention relates to atomic spectral lamps of the type comprising a predominantly glass envelope in which are disposed spaced electrodes for producing an electrical discharge on application of a suitable potential difference thereto, and a substance which on being heated, will yield a vapor of an element capable of emitting the resonance line or lines which characterize the lamp.

In the conventional lamp of this type, exemplified by the Wotan (trade mark) lamp, the electrical discharge provides energy both for production of the elemental vapour and for excitation of the vapour. Accordingly, an increase in the power output of the lamp results in higher elemental vapour pressure, which in turn leads to broadening of the resonance lines by self-absorption. It is an objective of the invention to provide a lamp in which this disadvantage is overcome.

In one aspect of the invention, there is accordingly afforded an atomic spectral lamp of the type comprising a predominantly glass envelope in which are disposed spaced electrodes for producing an electrical discharge on application of a suitable potential difference thereto and a substance which, on being heated will yield a vapour of an element capable of emitting the resonance line or lines which characterize the lamp, wherein the lamp further includes heating means for heating said substance independently of said discharge to yield said vapour within the envelope.

The heating means may comprise an ohmic resistance winding about a portion of the lamp envelope, which is preferably generally tubular. It will be appreciated that, in the lamp of the invention; the pressure of elemental vapour is determined by the temperature of the heating means and not by the excitation discharge across the electrodes, as in conventional lamps.

The prior lamps already discussed are not suited to the production of resonance lines of arsenic, selenium, sulphur and phosphorus since these elements tend to react with the cathode and thereby rapidly diminish the electron emitting capacity of the cathode.

The most commonly used light sources of arsenic and selenium are the hollow-cathode lamp and the electrodeless discharge lamp. The former type is far from satisfactory with respect to life-time and stability of output. The latter is an intense source and may be used for absorption and fluorescence measurements, but suffers from the disadvantages of a long warm-up time and a tendency for the output intensity to drift.

It may therefore be said that, at the present time, there exists a particular need for atomic spectral lamps for generating resonance lines of arsenic, selenium, phosphorus and sulphur since no satisfactory lamps for these elements are currently available.

This objective is achieved by the second aspect of the invention in that it provides an atomic spectral lamp of the type comprising a predominantly glass envelope in which are disposed spaced electrodes for producing an electrical discharge on application of a suitable potential difference thereto and a substance which, on being heated, will yield a vapour of an element capable of emitting the resonance line or lines which characterize the lamp, wherein the envelope, electrodes and substance are so arranged that, in normal operation of the lamp, there exists between the anode and the cathode a temperature gradient effective to ensure that the vapour pressure of the elemental vapour adjacent the cathode is small relative to the vapour pressure of the elemental vapour in the vicinity of substance.

The presence of the specified temperature gradient ensures that the elemental vapor, distilled continuously from the region of the substance which yields the elemental vapour, will re-condense on the cooler surface portions of the envelope. The vapour pressure in the region of the cathode can be kept very low, thereby effectively preventing poisoning of the electron emitter.

The lamp envelope may include a relatively enlarged bulbous portion adjacent the cathode. The substance which yields the elemental vapour may be disposed about the anode or alternatively, and preferably in the case of certain elements, the anode may be spaced from the substance at a location between the substance and the cathode.

Figure 2:
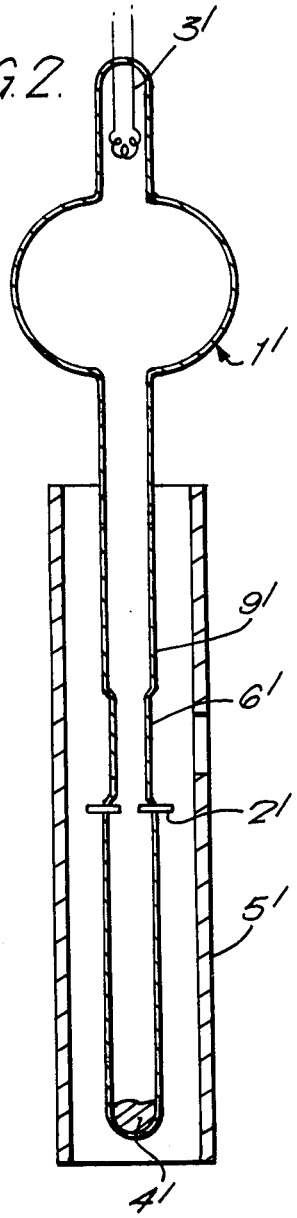

The invention will be further described by way of example only, with reference to the accompanying drawing, in which FIG. 1 diagrammatically depicts, in cross-section a lamp constructed in accordance with both aspects of the invention; and FIG. 2 is a view similar to FIG. 1, but showing an alternative embodiment of the inventive lamp.

The lamp illustrated in FIG. 1 includes a glass envelope 1 formed with a bulbous portion 8 and a tubular portion 9 and filled with an inert gas such as argon. An anode 2 and a cathode 3 are respectively mounted at the opposed extremities of the envelope in the tubular portion 9 and adjacent bulbous portion 8. An electrical discharge can be generated across the electrodes on application of a suitable potential difference thereto.

Disposed within portion 9 of the lamp envelope about anode 2 is a substance 4 which, on being heated, will yield a vapour of an element capable of emitting the resonance line or lines which characterizes the lamp. The anode 2 may be gold coated (for example by he reaction bonding technique disclosed in Australian Pat. No. 452,651) to prevent corrosion when the element is sulphur or phosphorus.

The cathode 3 is preferably of the type comprising an oxide coated filament. The part of the lamp envelope between points A and B shown, and including substance 4, is surrounded by a heater 5 which may comprise a simple ohmic resistance winding and which is intended to heat substance 4 to produce the required elemental vapour within the envelope.

In operation of the lamp there will be a temperature gradient $T_1$–$T_2$ along the length of envelope 1 between the anode 2 and the filament 3. The lamp parameters, and in particular those of the envelope, filament and heater, can be chosen so that the temperature gradient is effective to ensure that the vapour pressure of the elemental vapour adjacent filament 3 is small relative to the vapour pressure in the vicinity of deposit 4. The vapour distils from tubular portion 9 onto the cooler surface parts of bulbous portion 8. Poisoning of the filament by certain corrosive elements can thereby be minimised.

Lamp envelope 1 is provided with a silica neck 6 through which ultraviolet radiation is able to pass to a viewing port 7 in the heater 5 and thence to a monochromator as required. Neck 6 is formed as a constriction so as to increase current density.

As the energy for vaporization of the substance 4 to yield the elemental vapour is not derived primarily from the discharge current between electrodes 2,3 but rather from a separately controllable heating means 5, the amount of elemental vapour produced during operation can be controlled. Effective control of spectral line-width can therefore be attained without the necessity of under-running the lamp with subsequent lowering of effective excitation as is the case in prior art lamps of this type. The provision of a separate vaporizing heater makes the lamp especially suitable for the generation of atomic spectral lines of elements such as sulphur, phosphorus, potassium and sodium which possess relatively high vapour pressures under normal lamp operating conditions.

It has been found that the sensitivities of atomic fluorescence measurements of selenium and arsenic in aqueous solution using a non dispersive system with the present invention are at least of the same order as those obtained with electrode less lamps operated at recommended wattage.

In the lamp of FIG. 1, the substance 4 is still subject to some heating by the discharge to anode 2. Thus, there may still be some interdependence in the case of elements which vaporize at lower temperatures. The embodiment shown in FIG. 2 meets this difficulty in that the anode 2' is spaced from substance 4' at a location between the substance and the window neck 6'. The heater 5' again surrounds the tubular portion 9' of envelope 1'. To maintain rotational symmetry anode 2' is formed as an annulus of gold bonded (for example by the aforementioned reaction bonding technique) onto envelope 1'.

We claim:

1. An atomic spectral lamp of the type comprising a predominantly glass envelope in which are disposed spaced electrodes including a single anode and a single electron emitter filament cathode for producing an electrical discharge on application of a suitable potential difference to the electrodes and a substance that on being heated will yield a vapour of an element which characterizes the lamp and which is detrimental to the electron emitting capacity of said cathode, wherein said substance is so positioned that said vapour flows into the path of said discharge at a position spaced from said cathode, and wherein said envelope is provided with structural means so that in normal operation of the lamp, when said substance is heated there exists within the envelope a temperature gradient effective to ensure that the vapour pressure of the elemental vapour in the vicinity of the cathode is small relative to the vapour pressure of the elemental vapour at said position.

2. An atomic spectral lamp according to claim 1 wherein the envelope is generally tubular with the electrodes positioned at or near opposite ends thereof.

3. An atomic spectral lamp according to claim 2, wherein the envelope includes a constriction spaced from said cathode to increase current density in said discharge path and to define a viewing window.

4. An atomic spectral lamp according to claim 1, 2 or 3 wherein said substance is disposed about the anode.

5. An atomic spectral lamp according to claim 1, 2 or 3 wherein the anode is spaced from said substance at a location between the substance and the cathode and closer to said substance.

6. An atomic spectral lamp according to claim 1, 2 or 3 further including heating means for heating said substance independently of said discharge to yield a vapour of said element within the envelope.

7. An atomic spectral lamp according to claim 6 wherein the heating means is an ohmic resistance winding about a part of said envelope.

8. An atomic spectral lamp according to claim 1, 2 or 3 wherein said structural means of said envelope includes a relatively enlarged bulbous portion adjacent the cathode.

9. An atomic spectral lamp according to claim 6 wherein the anode is spaced from said substance at a location between the substance and the cathode.

10. An atomic spectral lamp according to claim 9 further including heating means for heating said substance independently of said discharge to yield a vapour of said element within the envelope.

11. An atomic spectral lamp according to claim 1 wherein the substance will, on being heated, yield a vapour of one of arsenic, selenium, sulphur and phosphorous.

12. An atomic spectral lamp according to claim 1, 2 or 3 wherein said filament cathode is a coated filament.

* * * * *